US009902190B2

(12) United States Patent
Hobbs

(10) Patent No.: US 9,902,190 B2
(45) Date of Patent: Feb. 27, 2018

(54) EXPANDING FOLDER

(76) Inventor: Jennifer Hobbs, Woodstock, GA (US)

( * ) Notice: Subject to any disclaimer, the term of this patent is extended or adjusted under 35 U.S.C. 154(b) by 0 days.

(21) Appl. No.: 13/234,093

(22) Filed: Sep. 15, 2011

(65) Prior Publication Data

US 2013/0068648 A1 Mar. 21, 2013

(51) Int. Cl.

| | |
|---|---|
| ***B42F 7/08*** | (2006.01) |
| *B42D 5/00* | (2006.01) |
| *B42F 13/40* | (2006.01) |

(52) U.S. Cl.

CPC ..... *B42F 7/08* (2013.01); *B42D 5/005* (2013.01); *B42F 13/40* (2013.01); *B42P 2241/04* (2013.01)

(58) Field of Classification Search

CPC . B42F 7/08; B42F 13/40; B42D 5/005; B42P 2241/04

USPC ..... 229/77, 62.3, 67.3, 67.1, 67.4; 206/232, 206/425, 215, 472–475, 320, 245; 283/42, 31; 190/11; 402/8; 281/31; 220/831, 832

See application file for complete search history.

(56) References Cited

U.S. PATENT DOCUMENTS

| | | | | |
|---|---|---|---|---|
| 1,613,536 | A * | 1/1927 | Rose | 132/315 |
| 1,794,560 | A | 3/1931 | Styll | |
| 2,280,889 | A * | 4/1942 | Buxton | 150/149 |
| 4,004,690 | A * | 1/1977 | Giarritta | 206/425 |
| 4,730,727 | A * | 3/1988 | Petroff | 206/311 |
| 4,932,520 | A * | 6/1990 | Ciarcia et al. | 206/232 |
| 5,020,673 | A | 6/1991 | Adams | |
| 5,026,196 | A * | 6/1991 | Brass | 402/79 |
| 5,593,086 | A | 1/1997 | Ho | |
| 5,630,509 | A | 5/1997 | Su | |
| 5,664,724 | A | 9/1997 | Ho | |
| 5,749,666 | A | 5/1998 | Yu | |
| 5,947,279 | A | 9/1999 | Lee et al. | |
| 5,954,170 | A * | 9/1999 | Chisholm | 190/109 |
| 5,975,170 | A * | 11/1999 | Anguiano | 150/159 |
| 5,984,092 | A | 11/1999 | Heard-William | |
| 5,996,778 | A * | 12/1999 | Shih | 206/45.2 |
| D448,799 | S | 10/2001 | Moor | |
| 6,296,112 | B1 | 10/2001 | Pettey | |
| 6,419,083 | B1 | 7/2002 | Huang | |
| 6,431,779 | B1 | 8/2002 | Moor et al. | |
| 6,578,706 | B2 | 6/2003 | Thompson | |
| 6,607,122 | B1 | 8/2003 | Ong | |
| 6,672,439 | B2 | 1/2004 | Platte | |
| 6,837,368 | B1 | 1/2005 | Chang | |
| 6,880,747 | B1 * | 4/2005 | Pelleg | 229/67.3 |
| D513,279 | S | 12/2005 | Hough et al. | |
| D521,072 | S | 5/2006 | Hough et al. | |
| 7,055,682 | B1 | 6/2006 | Domotor et al. | |

(Continued)

*Primary Examiner* — King M Chu
*Assistant Examiner* — James M Van Buskirk
(74) *Attorney, Agent, or Firm* — Crose Law LLC; Bradley D. Crose

(57) ABSTRACT

An expanding folder is disclosed. In at least one embodiment, an organizer apparatus includes: a generally planar, rectangular front cover; a generally planar, rectangular back cover; a spine whereby the front cover and back cover are coupled one to another at an edge of each to form a folder configured to open and close and to securely store and organize a plurality of loose papers; and at least one expandable file having a plurality of individual, expandable pockets disposed within the organizer apparatus on an inside surface of one or more of the front cover and the back cover.

19 Claims, 11 Drawing Sheets

(56) References Cited

U.S. PATENT DOCUMENTS

| | | | | |
|---|---|---|---|---|
| D529,963 | S | 10/2006 | Hough et al. | |
| 7,393,017 | B2 * | 7/2008 | Carmichael et al. | 281/15.1 |
| 7,699,165 | B2 | 4/2010 | Moeller et al. | |
| 7,909,234 | B2 | 3/2011 | Maistrellis | |
| 2007/0235506 | A1 * | 10/2007 | Shapiro | 229/67.3 |

* cited by examiner

EXPANDING FOLDER

FIELD OF THE INVENTION

The technology described herein relates generally to the storage and organization of documents in devices such as folders, organizers, pocketbooks, cases, and the like, for holding a multiplicity of items in an organized manner. More specifically, this technology relates to an organizer apparatus and portable filing system having expandable folder files to hold papers and documents in an organized manner.

BACKGROUND OF THE INVENTION

Folders and binders are known to store and organize loose leaf papers and the like. Many attempts have been made in the background prior art to improve upon a basic folder concept and storage means for papers and the like. There remain many shortcomings and deficiencies with those known devices in the background art.

Related patents known in the art include the following:

U.S. Pat. No. 7,055,682, issued to Domotor et al. on Jun. 6, 2006, discloses a padfolio with compartmentalized interior.

U.S. Pat. No. 6,578,706, issued to Thompson on Jun. 17, 2003, discloses a folding portfolio organizer.

U.S. Pat. No. 5,020,673, issued to Adams on Jun. 4, 1991, discloses a carrying case for personal items.

U.S. Pat. No. 5,984,092, issued to Heard-Willmon on Nov. 16, 1999, discloses a folding organizer.

U.S. Pat. No. 7,909,234, issued to Maistrellis on Mar. 22, 2011, discloses a compact storage device for receipts, coupons, and other small paper documents.

U.S. Pat. No. 6,837,368, issued to Chang on Jan. 4, 2005, discloses compact disc container.

U.S. Pat. No. 5,947,279, issued to Lee et al. on Sep. 7, 1999, discloses a storage system.

U.S. Pat. No. 5,630,509, issued to Su on May 20, 1997, discloses an accordion-like file.

U.S. Pat. No. 5,664,724 issued to Ho on Sep. 9, 1997, discloses a compartmentalized file folder apparatus.

U.S. Pat. No. 6,607,122, issued to Ong on Aug. 19, 2003, discloses combined detachable filing wallet devices.

U.S. Pat. No. 6,672,439, issued to Platte, III on Jan. 6, 2004, discloses a paper tote/organizer.

U.S. Pat. No. 5,593,086, issued to Ho on Jan. 14, 1997, discloses a document holder with an extensible-retractable bag.

U.S. Pat. No. 6,296,112, issued to Pettey on Oct. 2, 2001, discloses a compact disc folder booklet.

U.S. Pat. No. 6,419,083, issued to Huang on Jul. 16, 2002, discloses an accordion laser disc protective folder.

U.S. Pat. No. 7,699,165, issued to Moeller et al. on Apr. 20, 2010, discloses a multipurpose organizer system and folder with planner and/or writing surface and storage compartments.

U.S. Pat. No. D513,279, issued to Hough et al. on Dec. 27, 2005, discloses the ornamental design for a folio filer.

U.S. Pat. No. D521,072, issued to Hough et al. on May 16, 2006, discloses the ornamental design for a folio filer.

U.S. Pat. No. D529,963, issued to Hough et al. on Oct. 10, 2006, discloses the ornamental design for a folio filer.

U.S. Pat. No. 6,431,779, issued to Moor et al. on Aug. 13, 2002, discloses a binder with expandable pocket.

U.S. Pat. No. 5,749,666, issued to Yu on May 12, 1998, discloses an expandable file.

U.S. Pat. No. D448,799, issued to Moor on Oct. 2, 2001, discloses the ornamental design for a folder.

U.S. Pat. No. 1,794,560, issued to Styll on Mar. 3, 1931, discloses a correspondence folder.

The foregoing patents and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patents and other information do not teach or render obvious, singly or when considered in combination, the inventor's claimed invention.

BRIEF SUMMARY OF THE INVENTION

In various exemplary embodiments, the technology described herein provides an organizer apparatus and portable filing system having expandable folder files to hold papers and documents in an organized manner.

In one exemplary embodiment, the technology described herein provides an organizer apparatus. The organizer apparatus includes: a generally planar, rectangular front cover; a generally planar, rectangular back cover; a spine whereby the front cover and back cover are coupled one to another at an edge of each to form a folder configured to open and close and to securely store and organize a plurality of loose papers; and at least one expandable file having a plurality of individual, expandable pockets disposed within the organizer apparatus on an inside surface of one or more of the front cover and the back cover.

The organizer apparatus also can include: a first expandable file having a plurality of individual, vertical, expandable pockets disposed within the organizer apparatus on an inside surface of the front cover; and a second expandable file having a plurality of individual, vertical, expandable pockets disposed within the organizer apparatus on an inside surface of the back cover.

The organizer apparatus further can include an insertable writing tablet disposed within the organizer apparatus opposite the at least one expandable file.

The organizer apparatus also can include a ring binder closure mechanism disposed upon an inside edge of the spine of the organizer apparatus and configured to hold loose leaf paper.

In at least one embodiment, the at least one expandable file having a plurality of individual, expandable pockets disposed within the organizer apparatus on an inside surface of one or more of the front cover and the back cover comprises diagonal pockets, diagonal relative to the spine.

In at least one embodiment, the at least one expandable file having a plurality of individual, expandable pockets disposed within the organizer apparatus on an inside surface of one or more of the front cover and the back cover comprises pockets of varied heights.

In at least one embodiment, the at least one expandable file having a plurality of individual, expandable pockets disposed within the organizer apparatus on an inside surface of one or more of the front cover and the back cover comprises an accordion-type file having a plurality of dividers forming the expandable pockets.

The organizer apparatus further can include a closure device configured to secure the front cover and the back cover one to another to secure the organizer is a closed position.

The organizer apparatus also can include: a closure device disposed upon the outside front cover and configured to secure the front cover and the back cover one to another to secure the organizer in a closed position; and a tether coupled to the back cover at a first end and configured to couple to a receiver disposed upon an outside surface of the front cover.

The organizer apparatus further can include: a first closure device disposed upon the outside front cover and configured to secure the front cover and the back cover one to another to secure the organizer in a closed position; a second closure device disposed upon the inside front cover and configured to secure the front cover and the back cover one to another to secure the organizer in a reverse closed position; and a tether coupled to the back cover at a first end and configured to couple to one of a first receiver disposed upon an outside surface of the front cover and a second receiver disposed upon an inside surface of the front cover.

In at least one embodiment, the at least one expandable file having a plurality of individual, expandable pockets disposed within the organizer apparatus on an inside surface of one or more of the front cover and the back cover is translucent.

In at least one embodiment, the at least one expandable file having a plurality of individual, expandable pockets disposed within the organizer apparatus on an inside surface of one or more of the front cover and the back cover is expandable to such a degree that contents stored within are viewable without removal.

In another exemplary embodiment, the technology described herein provides an organizer apparatus. This organizer apparatus includes: a first closure device disposed upon an outside front cover and configured to secure the front cover and the back cover one to another to secure the organizer in a closed position; a second closure device disposed upon an inside front cover and configured to secure the front cover and the back cover one to another to secure the organizer in a reverse closed position; a spine whereby the front cover and back cover are coupled one to another at an edge of each to form a folder configured to open and close and to securely store and organize a plurality of loose papers; and a tether coupled to the back cover at a first end and configured to couple to one of a first receiver disposed upon an outside surface of the front cover and a second receiver disposed upon an inside surface of the front cover.

The organizer apparatus also can include at least one expandable file having a plurality of individual, expandable pockets disposed within the organizer apparatus on an inside surface of one or more of the front cover and the back cover. The expandable file is translucent in at least one embodiment.

In at least one embodiment, the at least one expandable file having a plurality of individual, expandable pockets disposed within the organizer apparatus on an inside surface of one or more of the front cover and the back cover comprises diagonal pockets, diagonal relative to the spine.

In at least one embodiment, the at least one expandable file having a plurality of individual, expandable pockets disposed within the organizer apparatus on an inside surface of one or more of the front cover and the back cover comprises pockets of varied heights.

In at least one embodiment, the at least one expandable file having a plurality of individual, expandable pockets disposed within the organizer apparatus on an inside surface of one or more of the front cover and the back cover comprises an accordion-type file having a plurality of dividers forming the expandable pockets.

In yet another exemplary embodiment, the technology described herein provides a portable filing system. The portable filing system includes: a generally planar, rectangular front cover; a generally planar, rectangular back cover; a spine whereby the front cover and back cover are coupled one to another at an edge of each to form a folder configured to open and close and to securely store and organize a plurality of loose papers; a first expandable file having a plurality of individual, expandable pockets disposed within the organizer apparatus on an inside surface of the front cover; a second expandable file having a plurality of individual, expandable pockets disposed within the organizer apparatus on an inside surface of the back cover; a first closure device disposed upon the outside front cover and configured to secure the front cover and the back cover one to another to secure the organizer in a closed position; a second closure device disposed upon the inside front cover and configured to secure the front cover and the back cover one to another to secure the organizer in a reverse closed position; and a tether coupled to the back cover at a first end and configured to couple to one of a first receiver disposed upon an outside surface of the front cover and a second receiver disposed upon an inside surface of the front cover.

In at least one embodiment, the first and second expandable files having a plurality of individual, expandable pockets disposed within the organizer apparatus on an inside surface of one or more of the front cover and the back cover are translucent.

In at least one embodiment, the first and second expandable files having a plurality of individual, expandable pockets disposed within the organizer apparatus on an inside surface of one or more of the front cover and the back cover are viewable without removal.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides an organizer apparatus and portable filing system having expandable folder files to hold papers and documents in an organized manner. The organizer apparatus is used for organization purposes. The organizer apparatus is adapted to hold loose papers or documents together for organization and protection. The organizer apparatus can be manufactured from various materials. By way of example, paper, card stock, plastic, polypropylene, and the like can be used in various embodiments. In alternative embodiments, the organizer apparatus includes an elastic closure and a zipper closure. Additionally, it yet another embodiment, hook-and-loop fasteners, such as Velcro®, are used for closure.

Figure 1:
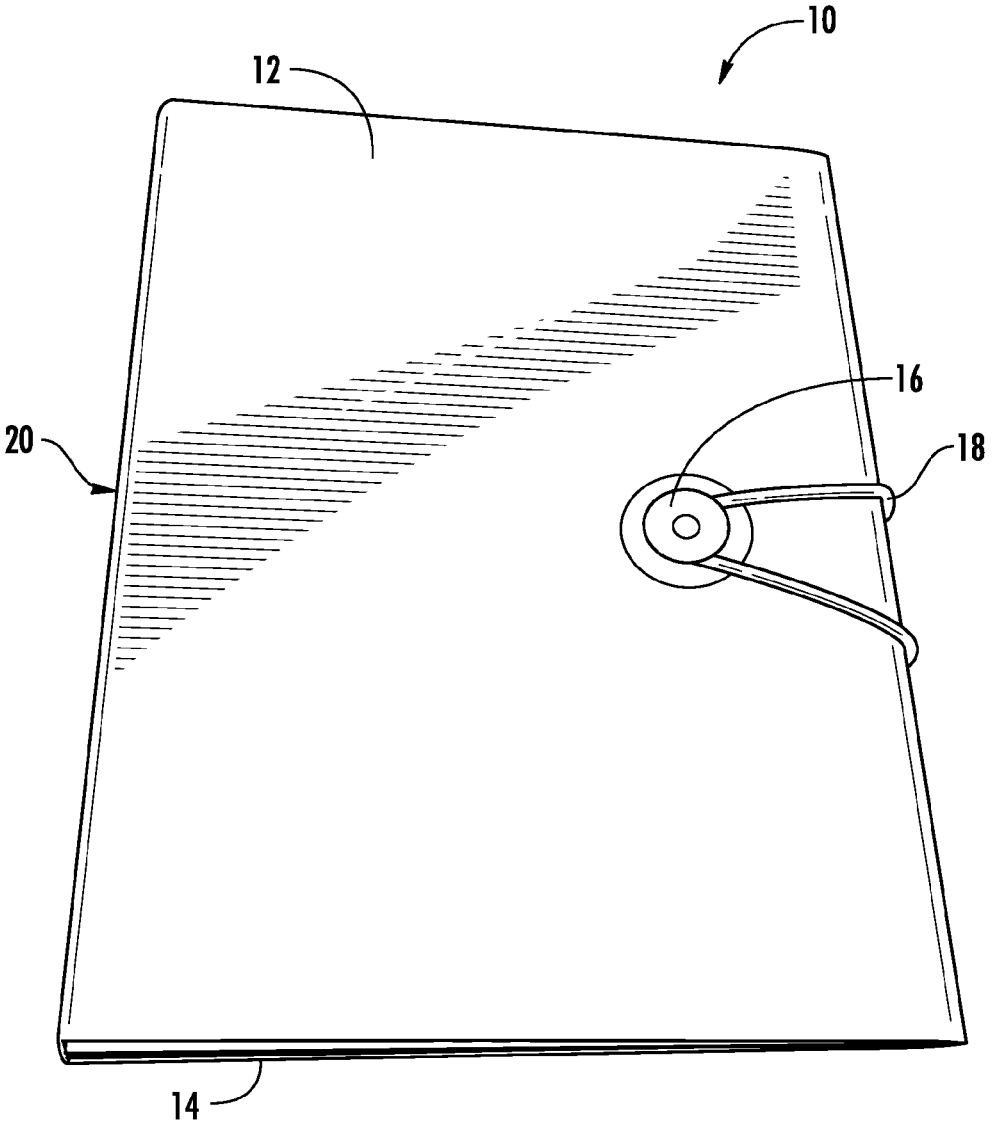
FIG. 1 is a front perspective view of an expanding folder, illustrating, in particular, the folder in a closed and secured position, according to an embodiment of the invention.

Referring now to FIG. 1, a front perspective view of an organizer apparatus, or expanding folder, 10 is shown. The organizer 10 includes a generally planar, rectangular front cover 12. The organizer 10 includes a generally planar, rectangular back cover 14.

The organizer 10 includes a spine 20 whereby the front cover 12 and back cover 14 are coupled one to another at an edge of each to form a folder. The organizer 10 in the form of a folder is configured to open and close and to securely store and organize a plurality of loose papers or other items.

The organizer 10 includes a closure device 16 configured to secure the front cover and the back cover one to another to secure the organizer 10 is a closed position. As depicted in FIG. 1, the closure device 16 is disposed upon the outside front cover 12 and configured to secure the front cover 12 and the back cover 14 one to another to secure the organizer 10 in a closed position.

The organizer 10 includes a tether 18 coupled to the back cover 14 at a first end and configured to couple to a closure device 16 disposed upon an outside surface of the front cover 12. As depicted in FIG. 1, the organizer is shown in a closed manner with the tether 18 coupled to the closure device 16 on the outside surface of the front cover 12. The location of the closure device 16 can vary on the outside surface of the front cover 12, and any other organizer surface upon which it is placed.

Figure 2:
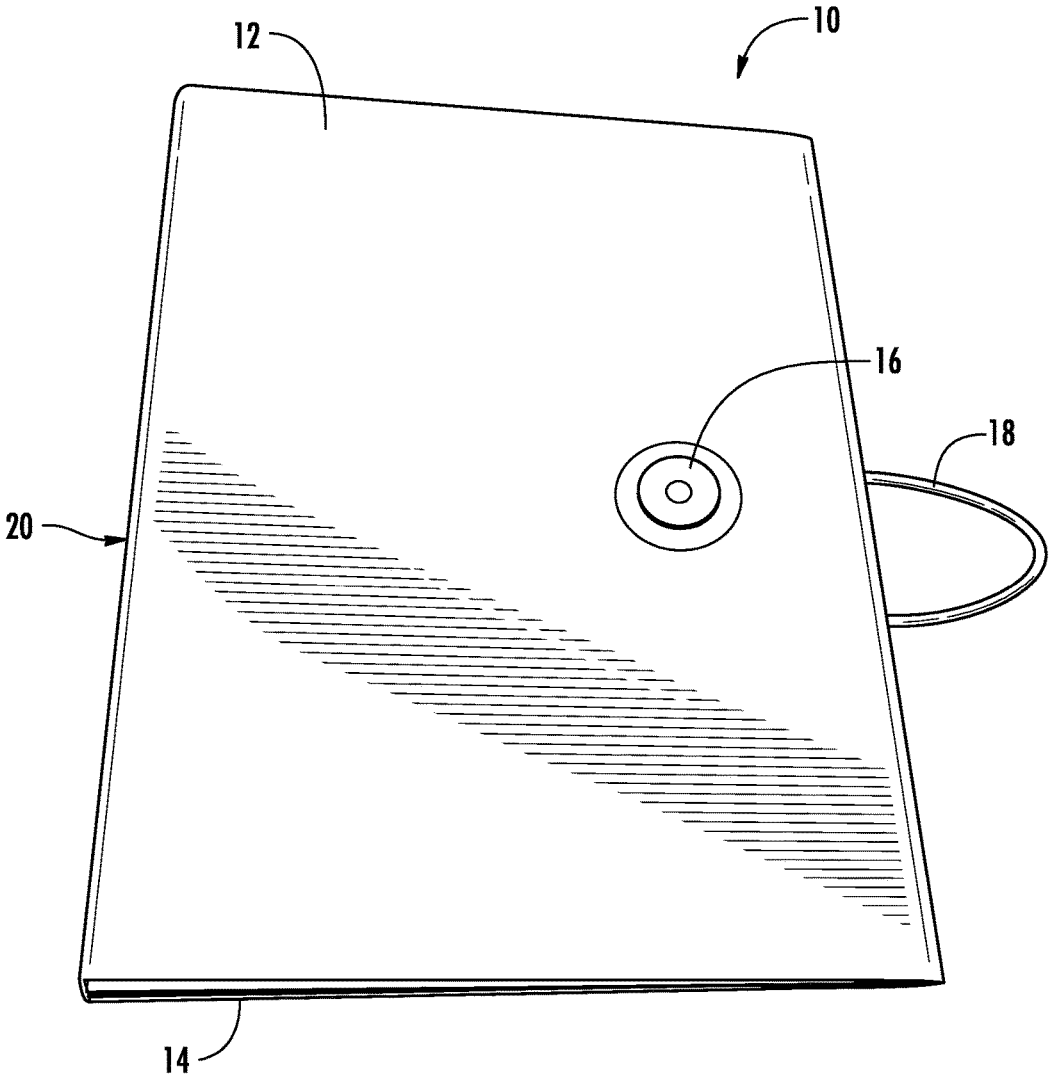
FIG. 2 is a front perspective view of the expanding folder depicted in FIG. 1, illustrating, in particular, the removal of the attachment means, according to an embodiment of the invention.

Referring now to FIG. 2, a front perspective view of an organizer apparatus, or expanding folder, 10 is shown, illustrating, in particular, the removal of the attachment tether 18. As the tether 18 is untethered by an operator from the closure device 16, the front cover 12 may be lifted away from the back cover 14 relative to the spine 20, to which the front cover 12 and back cover 14 are pivotably coupled. In at least one embodiment, the tether 18 is an elastic band.

Figure 3:
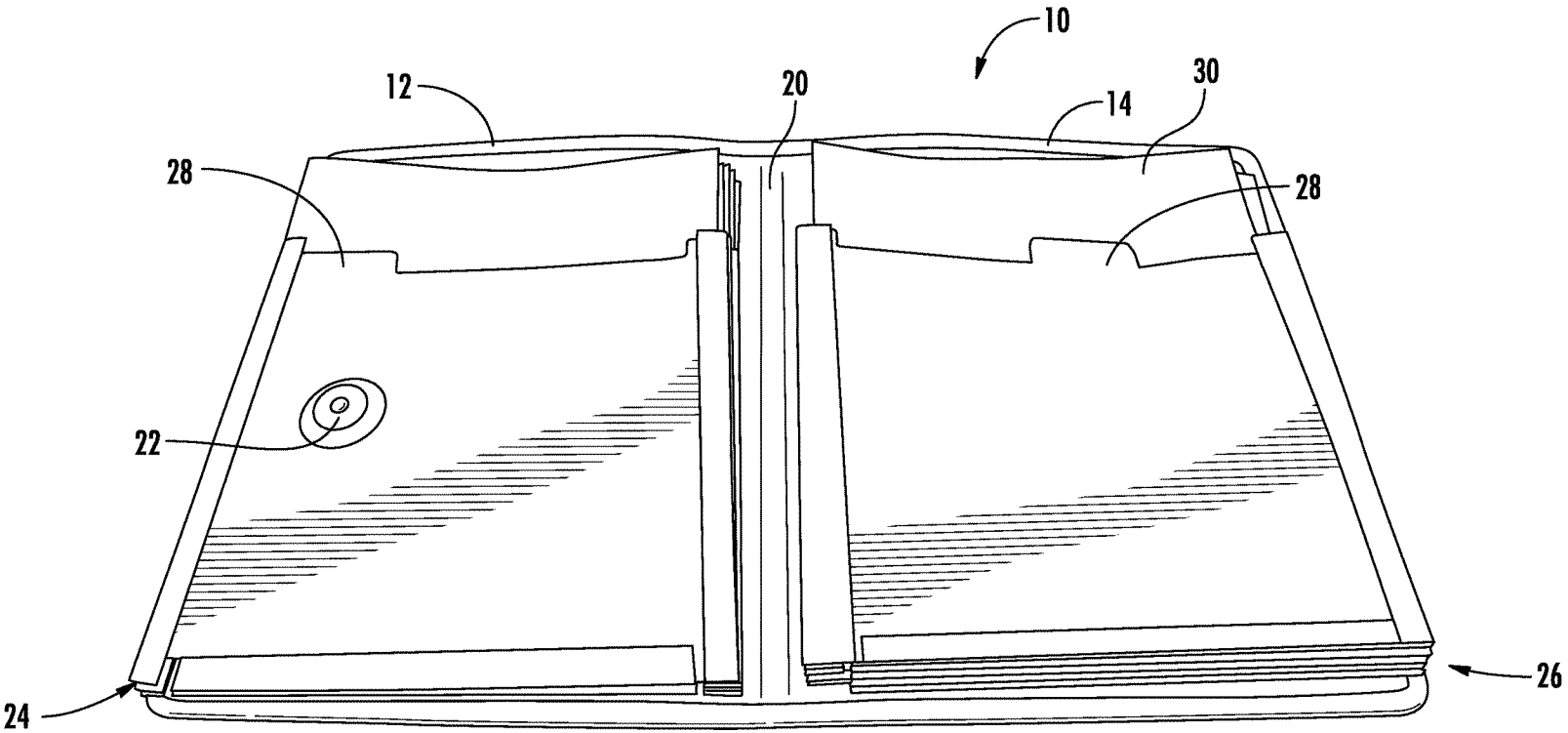
FIG. 3 is a front perspective view of the expanding folder depicted in FIG. 1, illustrating, in particular, the folder in an open position and a multiplicity of internal expanding pockets, according to an embodiment of the invention.
Figure 4:
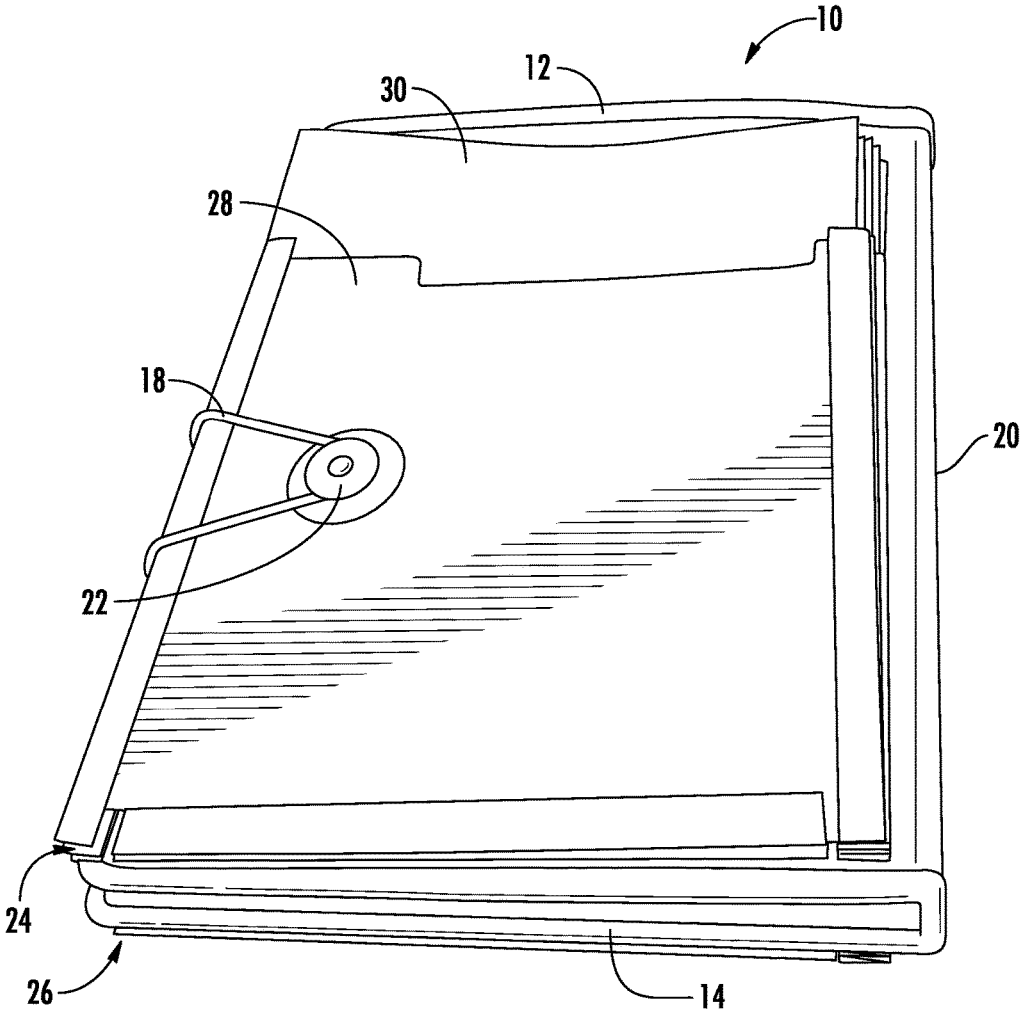
FIG. 4 is a front perspective view of the expanding folder depicted in FIG. 1, illustrating, in particular, the folder in a reversed closed position, having the pocket external to the folder, and the folder secured in this position, according to an embodiment of the invention.
Figure 5:
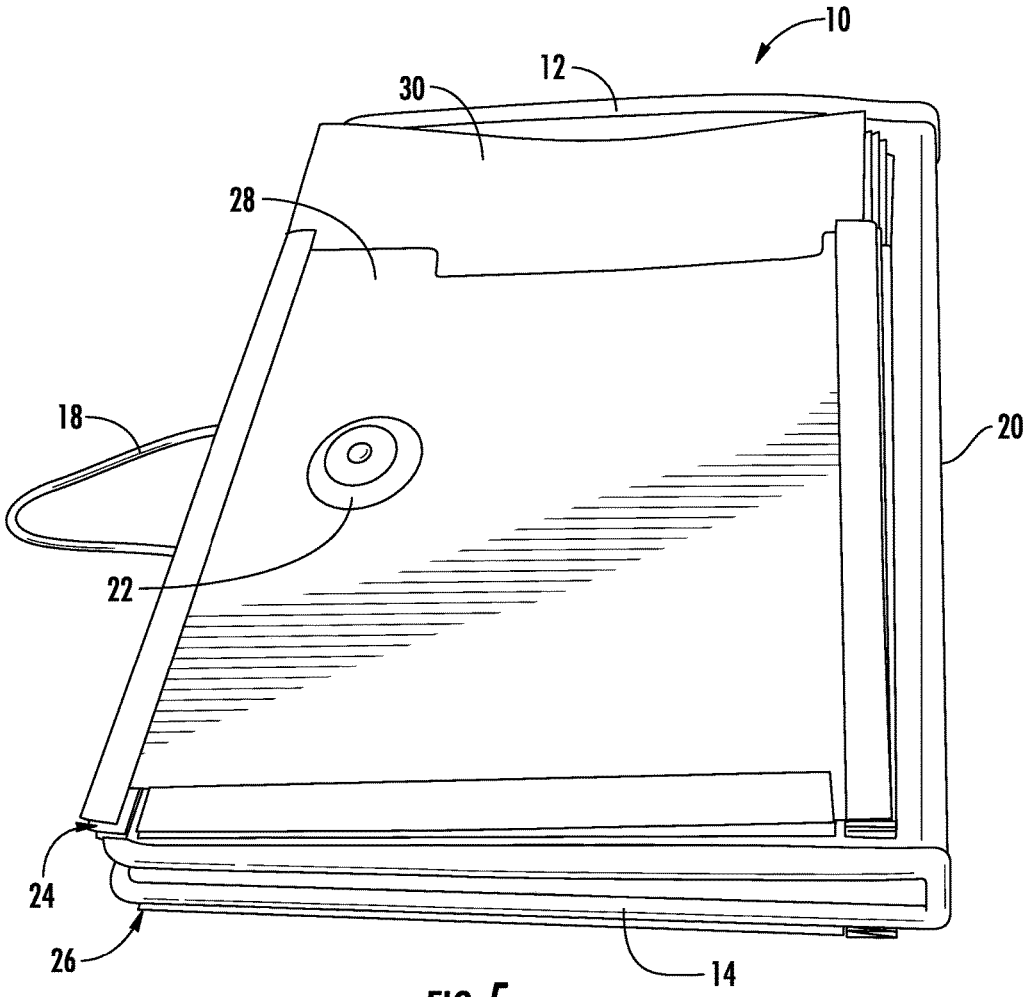
FIG. 5 is a front perspective view of the expanding folder depicted in FIG. 4, illustrating, in particular, the removal of the attachment means, according to an embodiment of the invention.

Referring now to FIG. 3, a front perspective view of the organizer 10 depicted in FIG. 1, illustrating, in particular, the organizer 10 in an open position. The spine 20 is more clearly depicted. The spine 20 is configured to couple the front cover 12 and back cover 14 one to another at an edge of each to form a folder. In a preferred embodiment, the spine 20 is flexible and bendable. The flexible and bendable spine 20 allows for the reverse closed position (as depicted in FIGS. 4 and 5), for example.

The organizer 10 includes at least one expandable file 24, 26 having a multiplicity of individual, vertical, expandable pockets disposed within the organizer apparatus 10 on an inside surface of one or more of the front cover 12 and the back cover 14. As depicted in FIG. 3, the organizer apparatus 10 includes a first expandable file 24 having a plurality of individual, vertical, expandable pockets disposed within the organizer apparatus 10 on an inside surface of the front cover 12 and a second expandable file 26 having a plurality of individual, vertical, expandable pockets disposed within the organizer apparatus 10 on an inside surface of the back cover 14.

Figure 10:
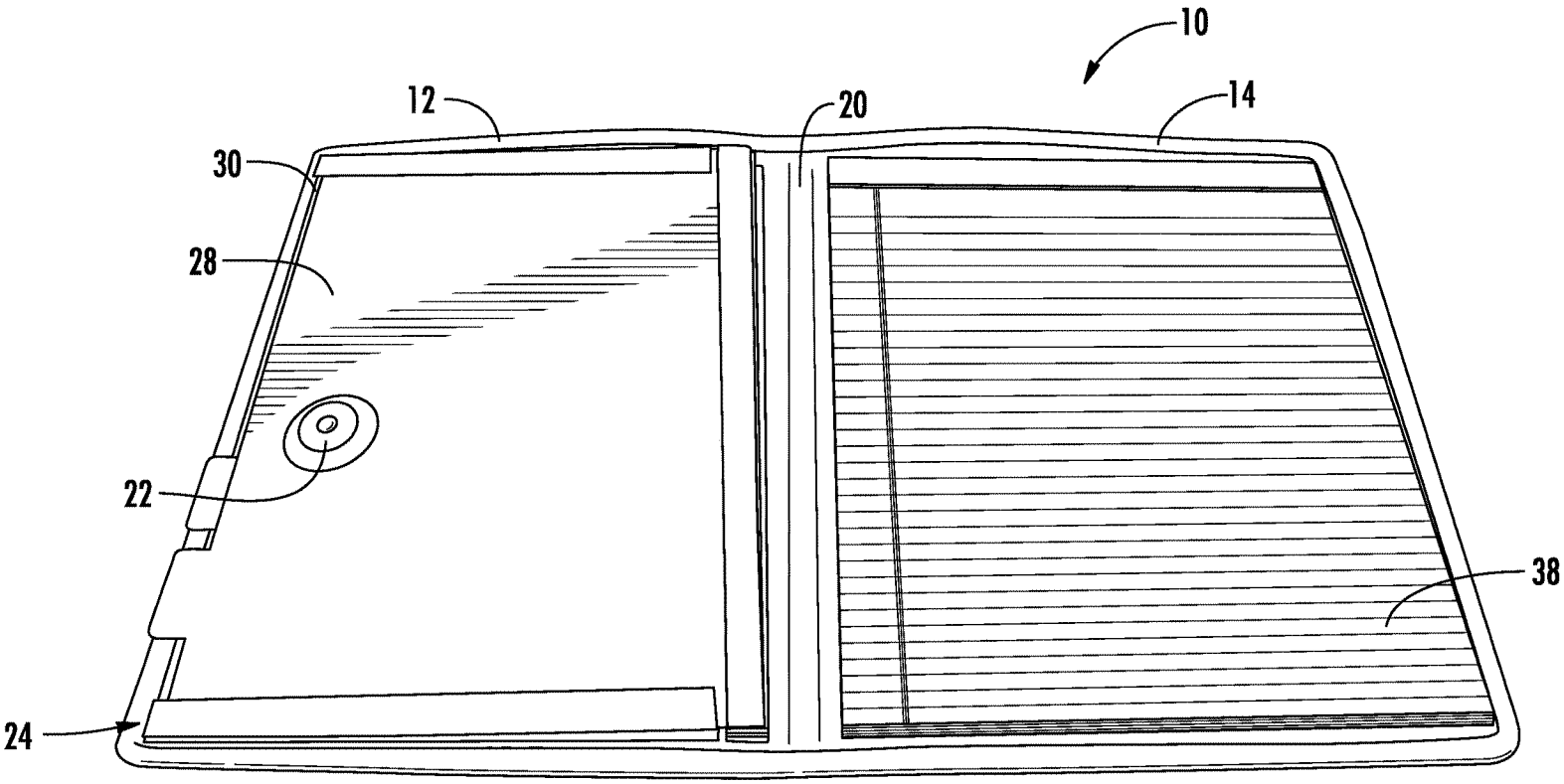
FIG. 10 is a front perspective view of an expanding folder, illustrating, in particular, expanding pockets opened to a side, and an inserted tablet, according to alternative embodiments of the invention.

Each expandable files 24, 26, having a multiplicity of individual, vertical, expandable pockets, further includes tabs 28, in at least one embodiment. The tabs 28 allow a user to easily select each pocket with the overall folder file system. The expandable files 24, 26 and the tabs 28 are upwardly or vertically facing as depicted in FIG. 3. However, in at least one alternative embodiment, the direction of the expandable files 24, 26 is horizontal rather than vertical, as depicted in FIG. 10 for example. The tabs 28 can be placed in varied locations. Additionally, the tabs 28 are translucent and insertable in at least one embodiment, such that an insert or label is inserted to identify what is held in a particular pocket.

In at least one embodiment, the expandable files 24, 26 having a plurality of individual, expandable pockets disposed within the organizer apparatus 10 on an inside surface of one or more of the front cover 12 and the back cover 14 comprises an accordion-type file having a plurality of dividers forming the expandable pockets.

In at least one embodiment, the organizer 10 includes a second closure device 22. The second closure device 22 is disposed upon the inside front cover 12 and configured to secure the front cover 12 and the back cover 14 one to another to secure the organizer 10 in a reverse closed position. The location of the second closure device 22 can vary on the inside surface of the front cover 12, and any other organizer surface upon which it is placed.

Figure 8:
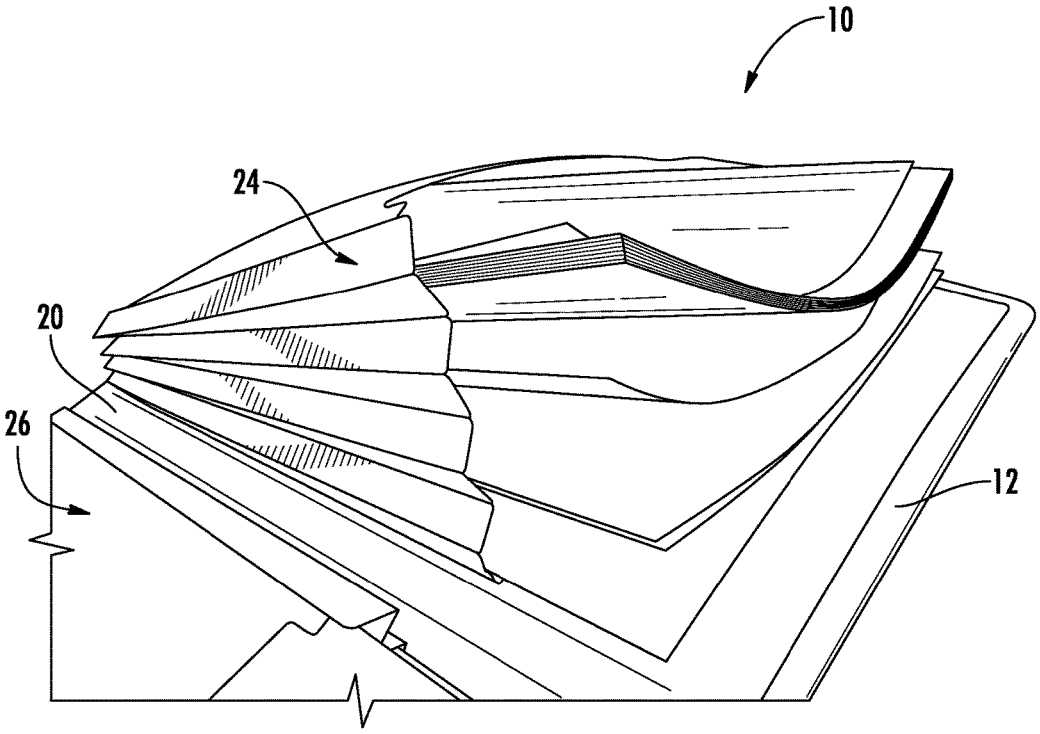
FIG. 8 is a perspective view of the multiplicity of internal expanding pockets, shown with the expanding folder in an open position, and shown expanded with the multiple layers of the pockets and inserted papers at each layer, according to an embodiment of the invention.

Stored within the expandable files 24, 26 are loose papers 30 and the like. In a preferred embodiment, the expandable files 24, 26 are translucent such that the folder owner may read the contents of papers 30 without removing them from the expandable files 24, 26. Furthermore, given the height of the pockets (as depicted for example in FIG. 8), as user may thumb through the pages and view the contents of the pocket without removing the contents from the pocket 24. As depicted in FIG. 8, the pockets are about three quarters the height of the papers shown. This provides the protection of the pockets while also allowing additional visibility and the ability to thumb through the pages without removing them if desired.

Referring now to FIG. 4, a front perspective view of the organizer apparatus 10 depicted in FIG. 1, is shown illustrating, in particular, the folder in a reversed closed position. An operator of the organizer 10 may open the organizer fully and the fold it back upon itself to close in a reverse closed position as depicted in FIG. 4. In this form the organizer 10 allows the owner to see materials stored within both expandable files 24, 26 without opening the folder.

The second closure device 22 is disposed upon the inside front cover 12 and configured to secure the front cover 12 and the back cover 14 one to another with tether 18 to secure the organizer 10 in a reverse closed position.

Referring now to FIG. 5, a front perspective view of the organizer apparatus 10 depicted in FIG. 4 is shown, illustrating, in particular, the removal of the attachment means. As depicted, tether 18 is removed from the second closure device 22. As such, the organizer apparatus 10 can be opened to a fully opened position (as depicted in FIG. 3) or closed to a fully closed position as depicted in FIG. 1.

Figure 6:
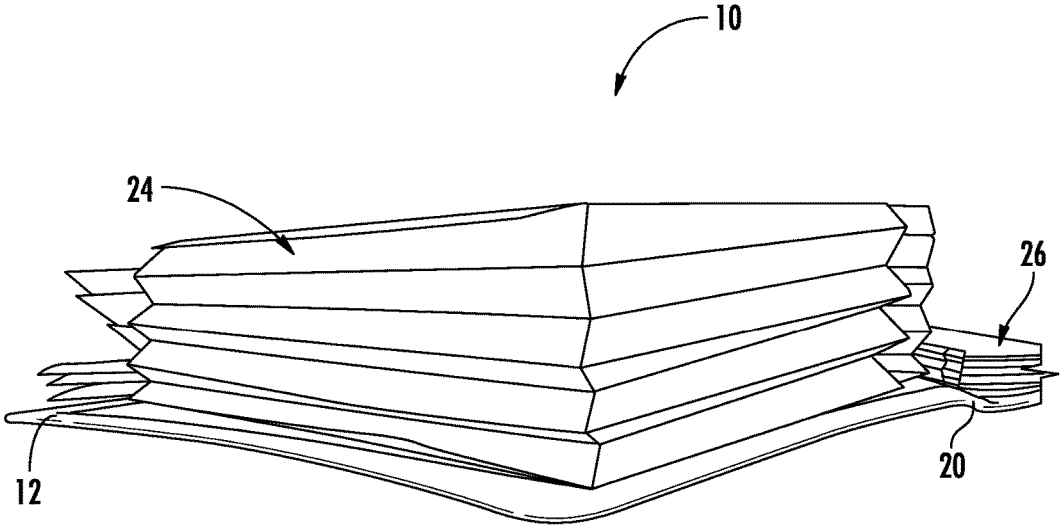
FIG. 6 is a front perspective view of the multiplicity of internal expanding pockets, according to an embodiment of the invention.

Referring now to FIG. 6, a front perspective view of the multiplicity of internal expanding pockets, 24, 26 of the organizer apparatus 10 is shown. The expanding pockets, 24, 26 are expandable as needed as various papers and the like are stored within them.

Figure 7:
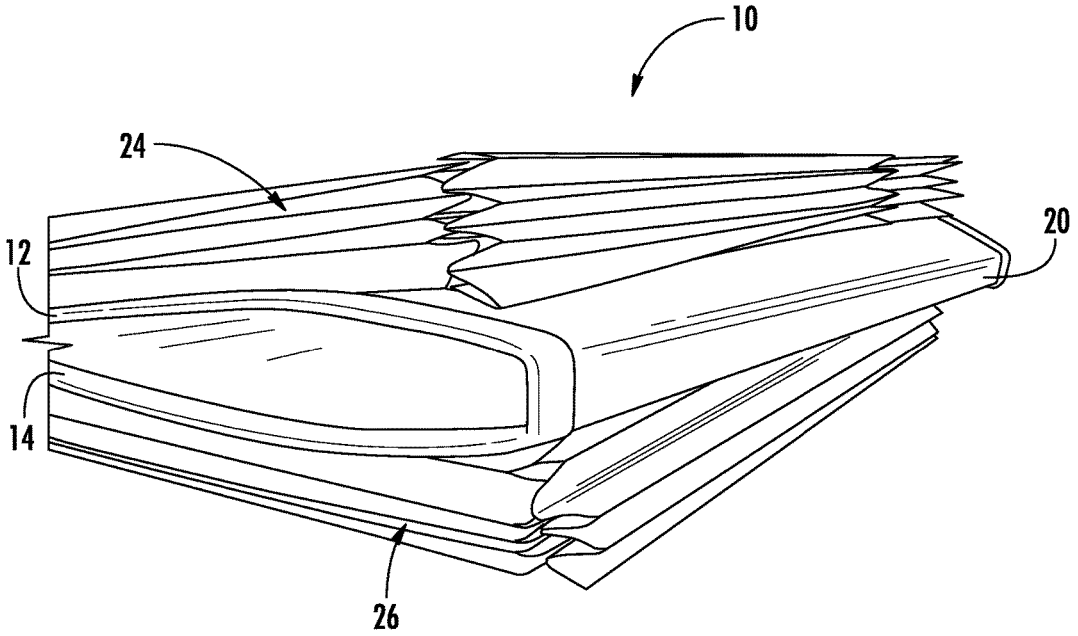
FIG. 7 is a perspective view of the multiplicity of internal expanding pockets, shown with the expanding folder in a reverse closed position, according to an embodiment of the invention.

Referring now to FIG. 7, a perspective view of the multiplicity of internal expanding pockets 24, 26 of the organizer apparatus 10 is shown in a reverse closed position. As shown in the front cover 12 and back cover 14 are back-to-back in a reverse position, bowed backwardly from the spine 20.

Referring now to FIG. 8, a perspective view of the multiplicity of internal expanding pockets 24, 26 is shown with the expanding folder 24 in an open position. The expanding folder 24 in an open position is shown fanned open away from front cover 12 and adjacent to the spine 20 and containing a multiplicity of papers, or the like. As depicted the expanding folder 24 is shown expanded with the multiple layers of pockets and inserted papers at each layer.

Figure 9:
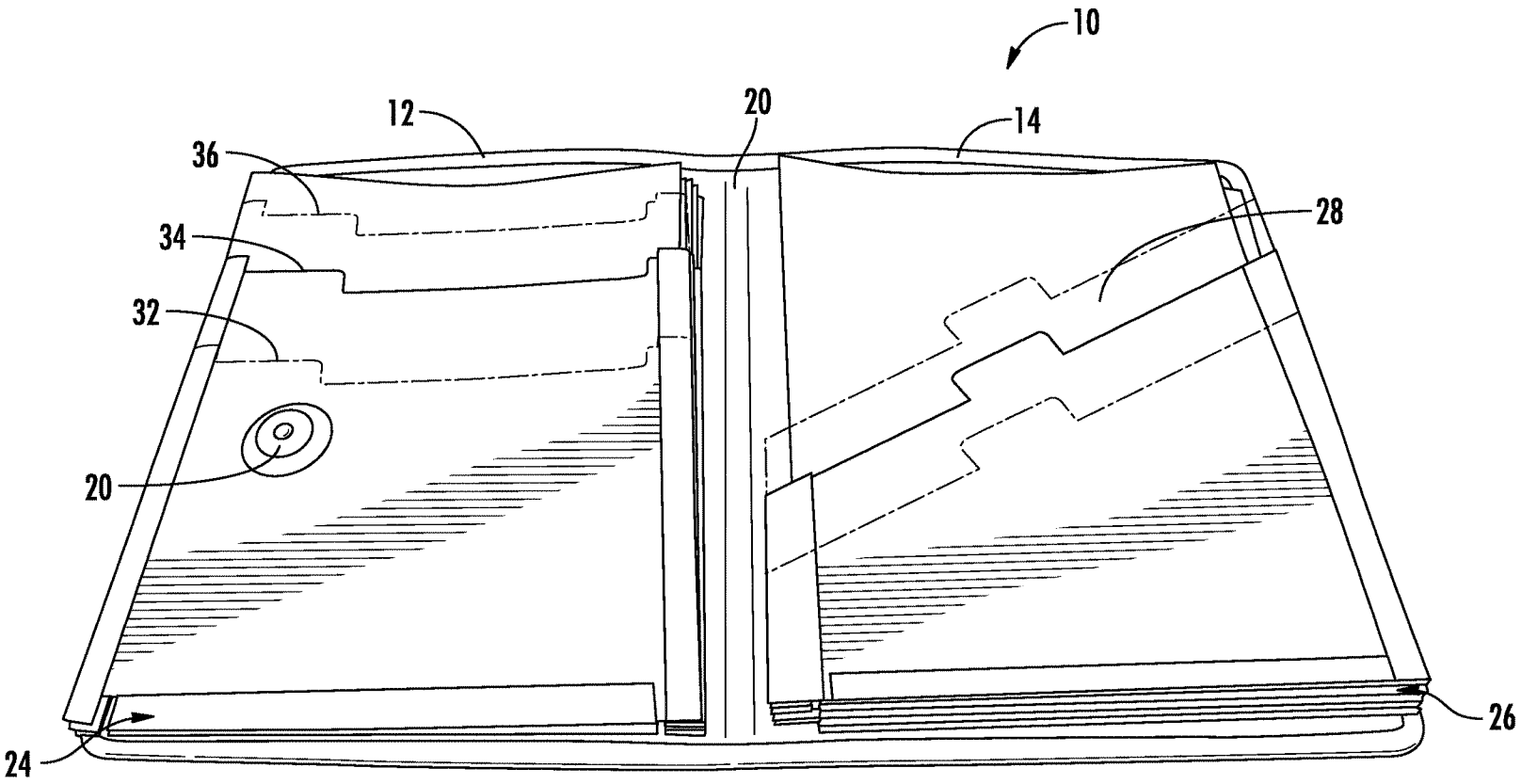
FIG. 9 is a front perspective view of an expanding folder, illustrating, in particular, expanding pockets at varied heights, and expanding pockets at diagonals, according to alternative embodiments of the invention.

Referring now to FIG. 9, a front perspective view of the organizer apparatus 10 is shown, illustrating, in particular, expanding pockets at varied heights, and expanding pockets at diagonals. As depicted on the front cover 12 side, the expanding pockets 24 shows pockets at varied heights, such a pocket height one 32, pocket height two 34, and pocket height three 36. Additionally, the expanding pockets can be in their thickness and number of overall pages contained within. As depicted on the back cover side 14, the expanding pockets 26 are implemented in diagonals. These expanding pockets 26 at diagonals can be implemented at the same height or at varied heights.

Referring now to FIG. 10, a front perspective view of the organizer apparatus 10 is shown, illustrating, in particular, expanding pockets opened to a side, and an inserted tablet. The inserted tablet 38 is shown on the back cover 14 side on the right side of the spine 20. The side 12, 14 upon which the inserted tablet 38 and the expanding pockets 24 can vary in alternative embodiments.

Figure 11:
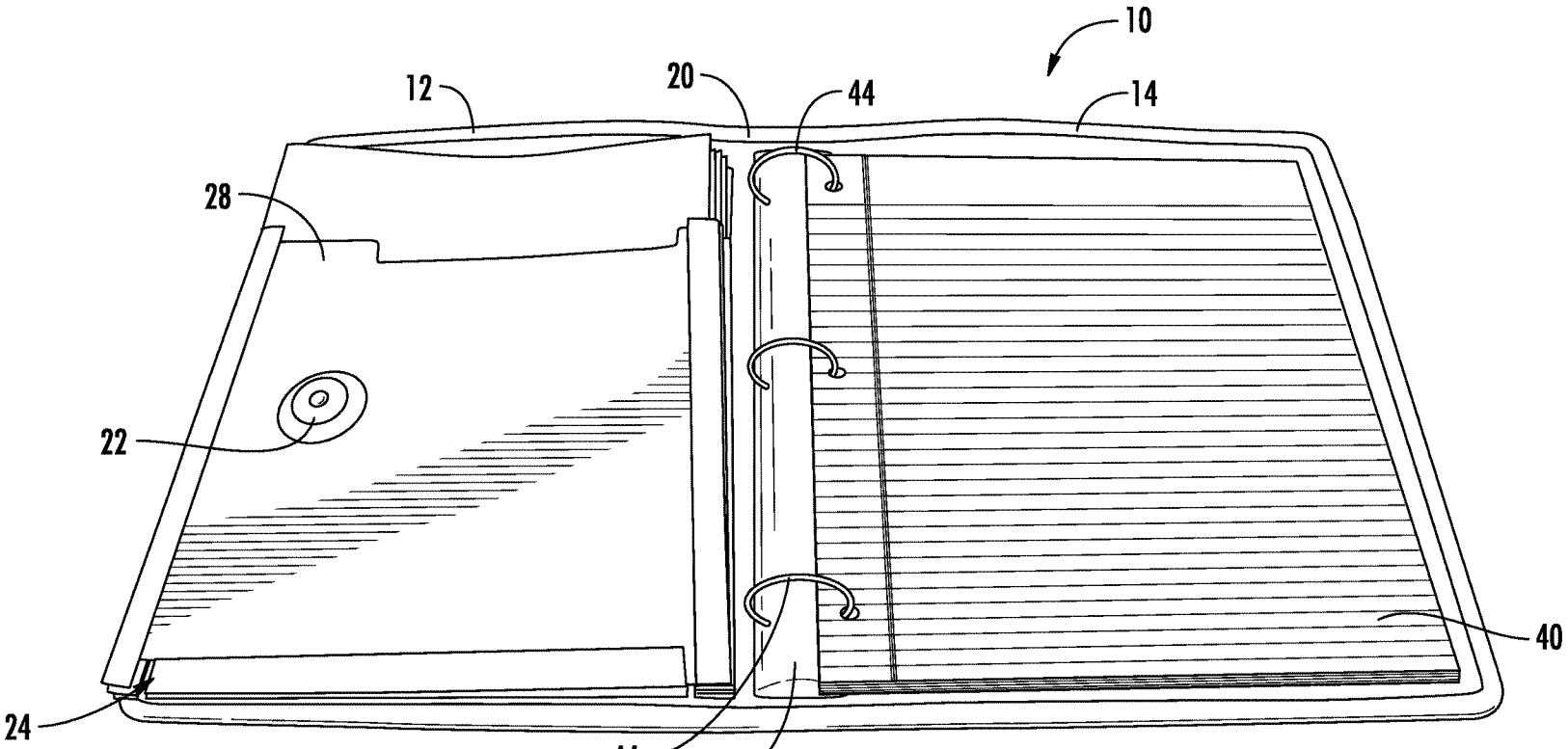
FIG. 11 is a front perspective view of an expanding folder, illustrating, in particular, expanding pockets opened upwardly, and a ring binder with inserted hole-punched paper, according to alternative embodiments of the invention.

Referring now to FIG. 11, a front perspective view of the organizer apparatus 10 is shown. The organizer apparatus 10 is shown illustrating, in particular, expanding pockets 24 opened upwardly, and a ring binder assembly with inserted hole-punched paper. The binder mechanism base 42 has a multiplicity of rings 44 that close upon hole-punched loose-leaf paper 40. The side 12, 14 upon which the ring binder assembly and the expanding pockets 24 can vary in alternative embodiments.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. An organizer apparatus comprising:

a generally planar, rectangular front cover;

a generally planar, rectangular back cover;

a spine whereby the front cover and back cover are hingedly coupled one to another at an edge of each to form a folder configured to open, the covers pivoting outwardly from the spine at each cover edge, and close, the covers pivoting inwardly to the spine at each cover edge, and to securely store and organize a plurality of loose papers; and at least one expandable file having a plurality of individual, expandable pockets disposed within the organizer apparatus on an inside surface of one or more of the front cover and the back cover, each of the plurality of expandable pockets coupled on three of four rectangular edges to the expandable file configured to permit inserts only from a single open side;

wherein the plurality of expandable pockets is configured to extend away from the inside surface from all four of the rectangular edges;

a first closure device disposed upon the outside front cover and configured to secure the front cover and the back cover one to another to secure the organizer in a closed position;

a second closure device disposed upon the inside front cover and configured to secure the front cover and the back cover one to another to secure the organizer in a reverse closed position; and a tether coupled to the back cover at a first end and configured to couple to one of a first receiver disposed upon an outside surface of the front cover and a second receiver disposed upon an inside surface of the front cover.

2. The organizer apparatus of claim 1, wherein the at least one expandable file further comprises:

a first expandable file having a plurality of individual, vertical, expandable pockets disposed within the organizer apparatus on an inside surface of the front cover; and a second expandable file having a plurality of individual, vertical, expandable pockets disposed within the organizer apparatus on an inside surface of the back cover.

3. The organizer apparatus of claim 1, further comprising:

an insertable writing tablet disposed within the organizer apparatus opposite the at least one expandable file.

4. The organizer apparatus of claim 1, further comprising:

a ring binder closure mechanism disposed upon an inside edge of the spine of the organizer apparatus and configured to hold loose leaf paper.

5. The organizer apparatus of claim 1, wherein the at least one expandable file having a plurality of individual, expandable pockets disposed within the organizer apparatus on an inside surface of one or more of the front cover and the back cover comprises diagonal pockets, diagonal relative to the spine.

6. The organizer apparatus of claim 1, wherein the at least one expandable file having a plurality of individual, expandable pockets disposed within the organizer apparatus on an inside surface of one or more of the front cover and the back cover comprises pockets of varied heights.

7. The organizer apparatus of claim 1, wherein the at least one expandable file having a plurality of individual, expandable pockets disposed within the organizer apparatus on an inside surface of one or more of the front cover and the back cover comprises an accordion-type file having a plurality of dividers forming the expandable pockets.

8. The organizer apparatus of claim 1, further comprising:

a closure device configured to secure the front cover and the back cover one to another to secure the organizer is a closed position.

9. The organizer apparatus of claim 1, further comprising:

a closure device disposed upon the outside front cover and configured to secure the front cover and the back cover one to another to secure the organizer in a closed position; and a tether coupled to the back cover at a first end and configured to couple to a receiver disposed upon an outside surface of the front cover.

10. The organizer apparatus of claim 1, wherein the at least one expandable file having a plurality of individual, expandable pockets disposed within the organizer apparatus on an inside surface of one or more of the front cover and the back cover is translucent.

11. The organizer apparatus of claim 1, wherein the at least one expandable file having a plurality of individual, expandable pockets disposed within the organizer apparatus on an inside surface of one or more of the front cover and the back cover is expandable to such a degree that contents stored within are viewable without removal.

12. An organizer apparatus comprising:

a first closure device disposed upon an outside front cover and configured to secure the front cover and the back cover one to another to secure the organizer in a closed position, wherein the front cover and the back cover are coupled front-to-front in the closed position;

a second closure device disposed upon an inside front cover and configured to secure the front cover and the back cover one to another to secure the organizer in a reverse closed position, wherein the front cover and the back cover are coupled back-to-back in the reverse closed position;

a spine whereby the front cover and back cover are hingedly coupled one to another at an edge of each to form a folder configured to open, the covers pivoting outwardly from the spine at each cover edge, and close, the covers pivoting inwardly to the spine at each cover edge, and to securely store and organize a plurality of loose papers; and an elastic band tether coupled to the back cover at a first end and configured to couple to one of a first receiver disposed upon an outside surface of the front cover and a second receiver disposed upon an inside surface of the front cover.

13. The organizer apparatus of claim 12, further comprising:

at least one expandable file having a plurality of individual, expandable pockets disposed within the organizer apparatus on an inside surface of one or more of the front cover and the back cover.

14. The organizer apparatus of claim 13, wherein the at least one expandable file having a plurality of individual, expandable pockets disposed within the organizer apparatus on an inside surface of one or more of the front cover and the back cover comprises diagonal pockets, diagonal relative to the spine.

15. The organizer apparatus of claim 13, wherein the at least one expandable file having a plurality of individual, expandable pockets disposed within the organizer apparatus on an inside surface of one or more of the front cover and the back cover comprises pockets of varied heights.

16. The organizer apparatus of claim 13, wherein the at least one expandable file having a plurality of individual, expandable pockets disposed within the organizer apparatus on an inside surface of one or more of the front cover and the back cover comprises an accordion-type file having a plurality of dividers forming the expandable pockets.

17. A portable filing system comprising:

a generally planar, rectangular front cover;

a generally planar, rectangular back cover;

a spine whereby the front cover and back cover are hingedly coupled one to another at an edge of each to form a folder configured to open, the covers pivoting outwardly from the spine at each cover edge, and close, the covers pivoting inwardly to the spine at each cover edge, and to securely store and organize a plurality of loose papers; and a first expandable file having a plurality of individual, expandable pockets disposed within the organizer apparatus on an inside surface of the front cover, each of the plurality of expandable pockets coupled on three of four rectangular edges to the expandable file configured to permit inserts only from a single open side;

a second expandable file having a plurality of individual, expandable pockets disposed within the organizer apparatus on an inside surface of the back cover, each of the plurality of expandable pockets coupled on three of four rectangular edges to the expandable file configured to permit inserts only from a single open side;

wherein the plurality of expandable pockets in both the first expandable file and the second expandable file are configured to extend away from the inside surface from all four of the rectangular edges;

a first closure device disposed upon the outside front cover and configured to secure the front cover and the back cover one to another to secure the organizer in a closed position;

a second closure device disposed upon the inside front cover and configured to secure the front cover and the back cover one to another to secure the organizer in a reverse closed position; and a tether coupled to the back cover at a first end and configured to couple to one of a first receiver disposed upon an outside surface of the front cover and a second receiver disposed upon an inside surface of the front cover.

18. The portable filing system of claim 17, wherein the first and second expandable files having a plurality of individual, expandable pockets disposed within the organizer apparatus on an inside surface of one or more of the front cover and the back cover are translucent.

19. The portable filing system of claim 17, wherein the first and second expandable files having a plurality of individual, expandable pockets disposed within the organizer apparatus on an inside surface of one or more of the front cover and the back cover are viewable without removal.

* * * * *